United States Patent [19]

Smith

[11] Patent Number: 4,884,905

[45] Date of Patent: Dec. 5, 1989

[54] PRINT HEAD INCORPORATING ONE PIECE ARMATURE WITH INTERMEDIATE CLAMPING PADS

[75] Inventor: Normand C. Smith, Charlotte, N.C.

[73] Assignee: International Business Machines Corporation, Armonk, N.Y.

[21] Appl. No.: 158,188

[22] Filed: Feb. 19, 1988

Related U.S. Application Data

[63] Continuation-in-part of Ser. No. 1,620, Jan. 9, 1987, abandoned.

[51] Int. Cl.[4] ..... B41J 3/12

[52] U.S. Cl. ..... 400/124; 101/93.05

[58] Field of Search ..... 400/124, 157.2; 101/93.05, 93.29

[56] References Cited

U.S. PATENT DOCUMENTS

| | | | |
|---|---|---|---|
| 3,828,908 | 8/1974 | Schneider | 400/124 |
| 4,211,496 | 7/1980 | Naylor | 400/124 |
| 4,225,250 | 9/1980 | Wagner et al. | 400/124 |
| 4,244,658 | 1/1981 | Mori | 400/124 |
| 4,394,093 | 7/1983 | Asano et al. | 400/124 |
| 4,422,784 | 12/1983 | Arzoumanian et al. | 400/157.2 |
| 4,591,280 | 5/1986 | Bringhurst | 400/124 |
| 4,704,041 | 11/1987 | Hayashi et al. | 400/124 |

FOREIGN PATENT DOCUMENTS

| | | | |
|---|---|---|---|
| 255148 | 2/1988 | European Pat. Off. | 400/124 |
| 150567 | 11/1981 | Japan | 400/124 |

OTHER PUBLICATIONS

*IBM Technical Disclosure Bulletin*, vol. 23, No. 6 dated Nov. 1980, p. 2260, "Print Hammer Element", E. F. Helinski.

*Primary Examiner*—David A. Wiecking

*Attorney, Agent, or Firm*—Dale Curtis Hogue, Sr.

[57] ABSTRACT

A wire dot matrix print head suitable for a low cost computer printer is described. The print head incorporates a one piece armature constructed of thin high strength sheet metal. The armature has a plurality of rigid radial arms radiating inwardly from a torsionally flexible periphery. Each of the rigid radial arms has an integral pair of flanges for adding rigidity, and an attached moving core of magnetically permeable material. Each of the rigid radial arms is connected to the periphery at an arm base. Each of the rigid radial arm bases is provided with a slight bend. The combination of torsional action of the flexible periphery acting at the bend and a fixed clamping action of a cap at intermediate portion of the flexible periphery provides a biasing force to each of the radial arms.

17 Claims, 6 Drawing Sheets

Fig. 9.
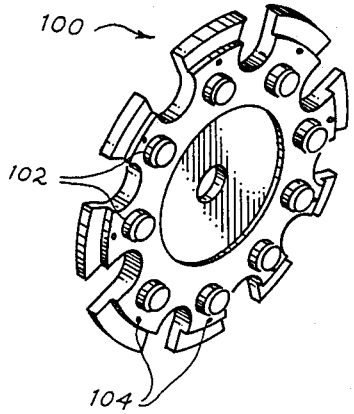
Fig. 8
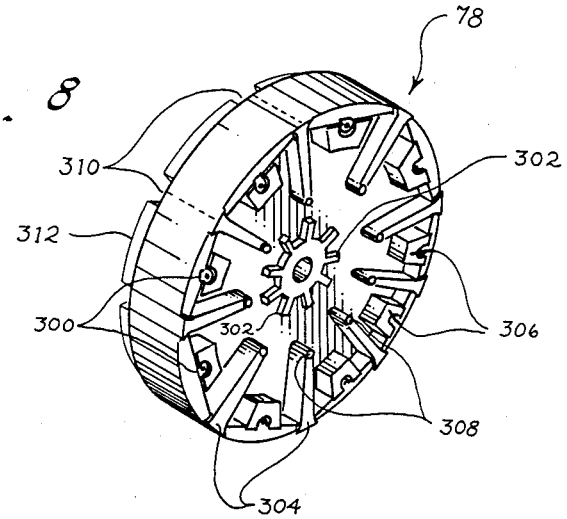
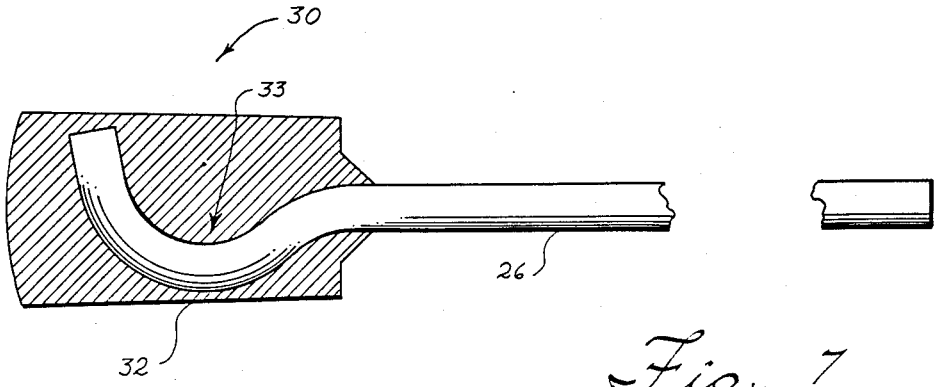
Fig. 7

Fig. 11
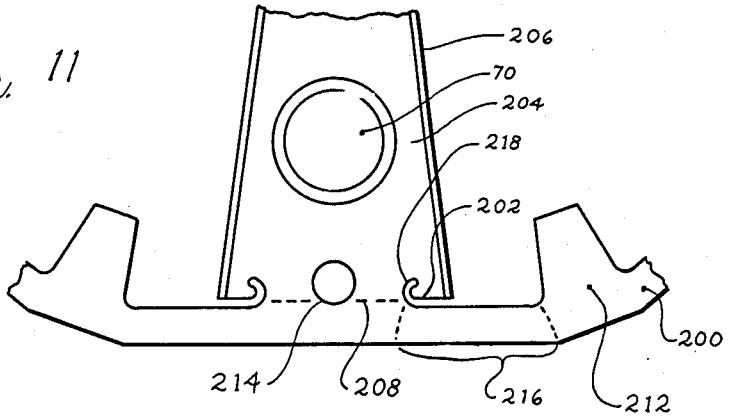
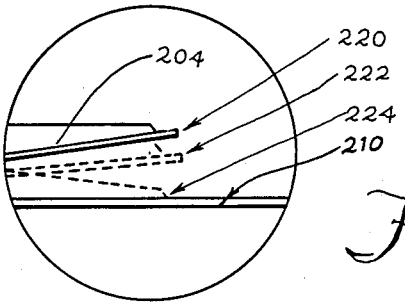
Fig. 12
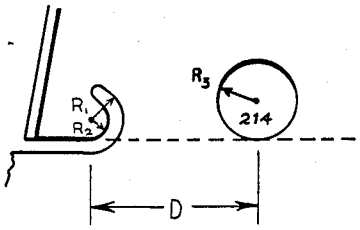
Fig. 14
Fig. 13
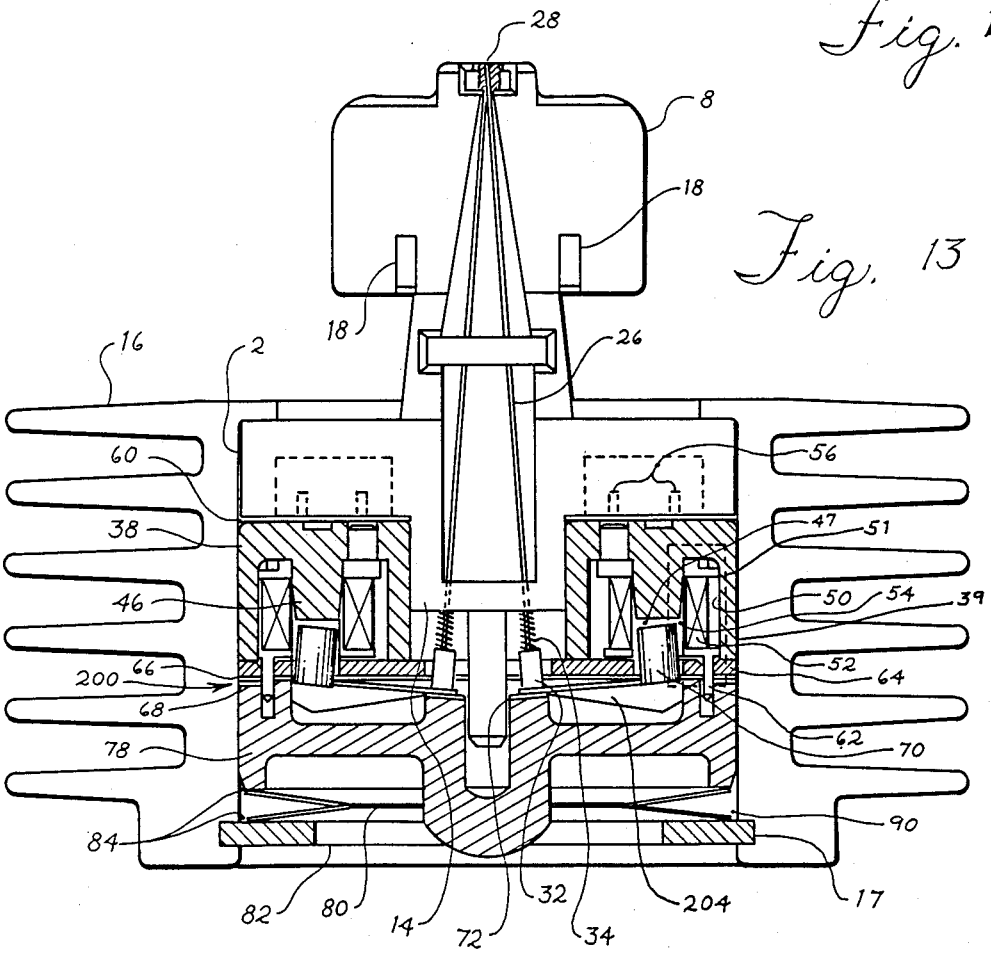

PRINT HEAD INCORPORATING ONE PIECE ARMATURE WITH INTERMEDIATE CLAMPING PADS

CROSS REFERENCE TO RELATED PATENTS

This is a continuation-in-part of co-pending patent application, Ser. No. 001,620 filed Jan. 9, 1987 , now abandoned.

BACKGROUND OF THE INVENTION

1. Technical Field

This invention relates to the field of wire dot matrix print heads. More particularly, this invention relates to an improvement in print actuating means wherein multiple armatures for driving the print wires are constructed from a single piece of sheet metal, and a multi-functional constraint for all the armatures is provided by a one piece molded plastic cap which is uniformly spring loaded by a one piece spring and retaining ring.

2. Background Art

Wire dot matrix print heads have been in use for many years and are noted for their versatility and low cost. In the prior art, wire dot matrix print heads are known to include a circular arrangement of electromagnets which are selectively energized to attract a moving core mounted on an armature. The attraction of the moving core urges the armature against a print wire. The print wire is driven against a ribbon which leaves a single dot on a record medium such as paper. The accumulation of dots produces printed characters. Examples of dot matrix print heads are disclosed in U.S. Pat. Nos. 3,770,092; 3,892,175; 4,244,658 and 4,569,605.

In dot matrix print heads of the prior art, individual armatures or actuating levers are provided. The individual armatures are radially aligned about a center point with each armature extending inwardly to a tip. The tip of the armature engages the end of a print wire. Electromagnetic coils are positioned relative to the armatures so that energization current passing through the coils creates a magnetic field attracting the armature toward the coil. The armature, moving under the attractive influence of the magnetic field, drives the print wire toward a print position. Each of the armatures of the prior art functions as a cantilever in that the armature is supported at the base, along the periphery of the print head, by a leaf spring.

The objectives in the design of a print head are to combine high speed and efficiency with ease of manufacture. One way to achieve higher print speeds and efficiency is to minimize both the armature mass and the gap between the core and armature. As the armature mass decreases, speed and efficiency increase, especially when operating in the ballistic mode and core/armature gap decreases, but there is a concomitant increase in the difficulty of manufacturing the print head due to the smaller, lighter weight, more fragile components. This invention makes the print head easier to manufacture by combining all of the armatures and their individual return springs into one assembly, and also by combining all the constraining members into a one piece molded plastic cap. The result is a faster, more efficient print head that is easy to manufacture.

SUMMARY OF THE INVENTION

With the print head of the present invention, numerous goals and objectives have been obtained that combine in a synergistic way to provide a simple, easily manufactured and high speed print head. An objective achieved by the print head employing the one piece armature is a reduction in the total number of parts to be assembled. In a nine wire print head of the prior art, nine separate armatures and coil springs were required. With the one piece armature of this invention, those eighteen parts are replaced with a single part.

Another feature of the one piece armature design is a reduction in the number of parts that require critical alignment. In the prior art, the individual armatures had to be aligned with each other as well as the electromagnetic coils. With the one piece armature of this invention, the relative positions of the armatures and the cap are accounted for in the manufacturing process thus eliminating an entire set of constraints and potential adjustments Another feature of the one piece armature is a substantially reduced armature mass with a proportionate rise in print speed and efficiency. The lower mass is achieved with the use of very thin high strength sheet metal such as Carpenter 455. An additional advantage of low mass is that less heat is generated in the print head with a resulting increase in duty cycle.

Another feature of the invention is a one piece armature having a straight sided torsionally flexible outer periphery, each side of which has two critically sized, symmetrical torsion spring sections which provide a return torque to the base region of each of the rigid radial arms. Each of the torsion spring sections is extended tangentially inward toward the center of the arm base region, to within the outer corner of the base, and connects to the central part of the base of the rigid radial arm via an integrated transitional region designed to reduce stress concentration. The extended torsional spring sections permit longer strokes of the rigid radial arms needed for ballistic print wire printing on variable forms thicknesses, without increasing the stresses in the torsion springs above the endurance limit of the material.

Another feature of the one piece armature print head design is a multi-function one piece molded plastic cap that is aligned via a center post hole and bobbin pin holes so as to have precise positioning with respect to mating surfaces on the previous assembly. The cap restrains the base of the arms, preventing bounce at the end of the return stroke of the rigid radial arms and supports the backstop which limits the return stroke of the rigid radial arms. The cap holds the central region of the residual against the flux plate, and unilaterally limits the tolerance on the length of the print wire strokes. The cap also transmits a spring preload force to the clamped region of the flexible outer periphery of the one piece armature and also provides for self-aligning of the next part to be assembled, the clamping preload spring, via a central locating post and castle periphery with ledges to accommodate the preload spring fingers. Each ledge being directly over the outer end of a clamping arm which loads a peripheral clamped pad.

Another feature of the one piece armature is the synergistic magnetic effect obtainable from an alternate unique shape for the upper magnetic gap between the flux plate and the top of the moving core, focusing flux through the gap in such a manner as to augment the force in the lower magnetic gap, thus increasing the overall efficiency, reducing the heat input, and thus accommodating higher printing speeds and duty cycles.

The print head of this invention has a frame assembly that includes a main frame, a wire guide and a nose. In the frame assembly is mounted a print wire assembly. The print wire assembly includes a plurality of wire rods; each of the wire rods has one end for driving a ribbon against a record medium and a second end that includes a print wire head and a spring. The spring is compressed between the print wire head and the main frame spring seat.

A stator assembly includes a plurality of coil assemblies, a focus plate and a residual or insulating means. Each of the coil assemblies has a coil surrounding a fixed post defining a cavity. The fixed post and the focus plate are constructed of a magnetically permeable material.

A signal means is provided for selectively activating and deactivating each of the coil assemblies. Mounted adjacent to the stator assembly is the one piece armature comprised of a flexible periphery with a plurality of rigid radial arms connected at the periphery and radiating inwardly therefrom for driving the print wire assemblies in a forward direction. Each of the rigid radial arms has a pair of folded flanges for rigidity and is associated with an individual arm base. Each of the arm bases has a slight bend for biasing the associated radial arm in a rearward direction against a backstop. The rearward biasing of said rigid radial arm is provided by the combination of the slight bend in the arm base, torsional action in the flexible periphery and reaction against the clamped pad.

When activated, each of the coil assemblies drives the associated rigid radial arm against one of said print wire heads. When the coil is deactivated, the slight bend in the the arm base, being reacted upon torsionally through the flexible outer periphery, in combination with the print wire spring, provides a biasing action for returning the rigid radial arm to a rest position against the backstop.

BRIEF DESCRIPTION OF THE DRAWINGS

FIG. 7 is a side view of a print wire useful in the present invention.

FIG. 8 is an enlargement of the underside portion of the end cap depicted in FIG. 2.

FIG. 9 is a manufacturing jig used to align the coils accurately in a metallic cup.

FIG. 11 is a plan view of a portion of the one piece armature showing details of the rigid radial arm, the base, the torsion spring, moving core and clamped pad.

FIG. 12 is an enlargement of the indicated portion of FIG. 4 showing the different positions of the inner end of a rigid radial arm.

FIG. 13 is an enlarged sectional view of an assembled print head.

FIG. 14 shows the geometric relationship between cut out 218 and hole 214.

DETAILED DESCRIPTION OF THE PREFERRED EMBODIMENTS

Figure 1:
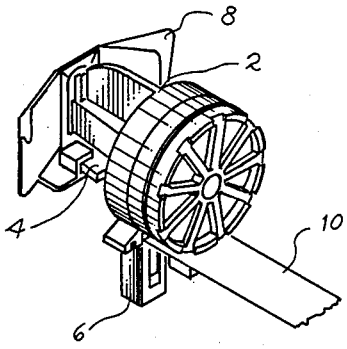
FIG. 1 shows a print head, without heat sink and retention means, made according to the present invention.

The print head for a serial dot matrix printer made according to the present invention is illustrated in FIG. 1 and comprises frame assembly 2, including nose 4, with a carriage mounting bracket 6. Affixed to nose 4 is ribbon guide 8 for guiding the ribbon (not shown) during the printing operation. Flexible cable 10 electronically connects the print head to suitable print control means in a printer as is well known by those skilled in the art.

Figures 2, 5:
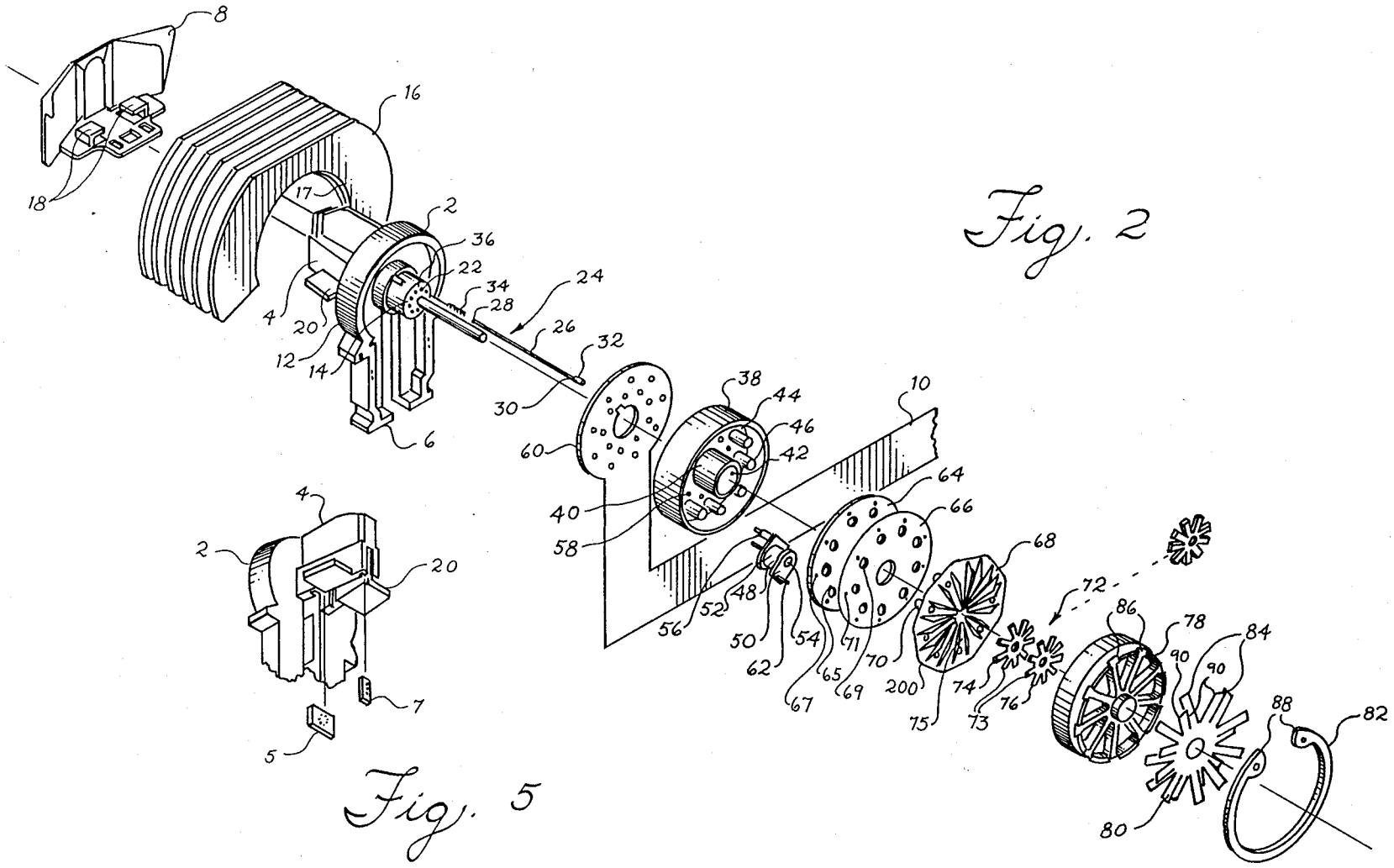
FIG. 2 is an exploded view of the print head of FIG. 1 including a heat sink and retention means.
FIG. 5 shows the underside of the nose 4 depicted in FIG. 2 with the print wire guides exposed.

Referring now to FIG. 2, the individual components of the print head can be described. Frame assembly 2 is comprised of nose 4, main frame 12 and wire guide 14. In the preferred embodiment, frame assembly 2 is constructed of molded plastic. Mounting bracket 6 comprises part of frame assembly 2 in the preferred embodiment and is disposed for mounting the entire print head on a carriage assembly (not shown) of the printer (not shown). A ribbon guide 8 is mounted on nose 4 by means of mounting brackets 18. The underside of nose 4 is depicted in FIG. 5 and shows wire separator 5 and nose guide 7 exposed.

Referring again to FIG. 2, wire guide 14 has a plurality of wire receiving means 22 for supporting each of the wire assemblies 24. In, the preferred embodiment there are nine wire receiving means, one for each of the nine wire assemblies. Each wire assembly 24 includes a wire rod 26, which has one end 28 for driving an inked ribbon against a print medium and a second end 30 for receiving a driving force. Second end 30 includes print wire head 32 for compressing biasing spring 34 against spring seat 36 of wire receiving means 22. Referring to FIG. 7, a cut away view of second end 30 is shown where print wire head 32, constructed of a molded plastic material such as Delrin, surrounds hook 33.

Again referring to FIG. 2, a highly permeable, magnetic flux conducting, constraining yoke, in the form of metallic cup 38, abuts frame assembly 2 separated by signal means 60. Metallic cup 38 has central bore 40 and opening 42 for receiving and surrounding wire receiving means 22. An annular seat 44, surrounding bore 40, has a plurality of posts 46. Each of posts 46 has mounted thereon a coil assembly 48, only one of which is shown. Coil assembly 48 has a bobbin 50, about which is wound coil 52, with a cavity 54 for receiving post 46. Bobbin 50 also has pins 56 which have soldered to them the ends of coil 52. Pins 56 extend through holes 58 in annular seat 44 and are connected to signal means 60.

Bobbin 50 includes locating pin 62 for orienting the position of flux plate 64, residual 66, one piece armature 68 and cap 78. Referring also to FIG. 9, there is shown jig 100 used to align precisely the coil assemblies 48 on posts 46 of metallic cup 38. The individual coil assemblies 48 are mounted on the jig mounting posts 102 so that locating pin 62 fits in holes 104. When all of coil assemblies 48 are mounted on jig 100, the posts 46 of metallic cup 38 are aligned with cavity 54 of bobbins 50, pressed together and a potting compound is then applied to hold the assemblies 48 in place. Jig 100 is then removed and the individual coil assemblies 48 are precisely fixed in metallic cup 38.

Focus plate 64 also known as a flux plate, abuts metallic cup 38 and has openings 65 for receiving moving core 70. Holes 67, of focus plate 64, are for receiving locating pin 62 of coil assembly 48. Focus plate 64 is constructed of a highly permeable magnetic material such as Hiperco 50 A. Electrically separating focus plate 64 from one piece armature 68 is residual 66 constructed of an insulating material such as Dupont Kapton. Residual 66 has openings 69 and holes 71 that align with openings 65 and holes 67 of focus plate 64.

Moving core 70, constructed of Hiperco 50 A (which is a high permeability, high saturation level, low coercive force magnetic material), of one piece armature 68 is seated inside opening 69 of residual 66 and opening 65 of focus plate 64 and fits within cavity 54 of coil assembly 48 to define a gap 47 (FIG. 13) between moving core 70 and post 46. Backstop 72, comprised of polyurethane skin 74 and butyl rubber 76, is provided with fingers 73 that reach between the folded flanges and align with arms 75 of one piece armature 68 to absorb recoil energy produced by the return of wire assembly 24 and the rigid arm 75. In an alternative embodiment, backstop 72 is a single piece of urethane constructed of 100 parts Vibrathane 821 from Uniroyal to 12.7 parts curative A931 also available from Uniroyal.

Figure 3:
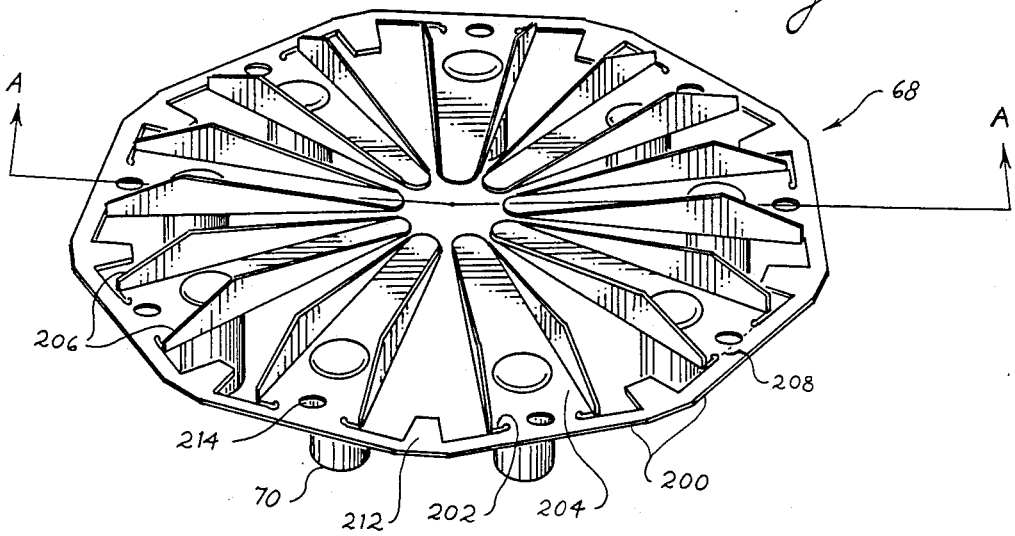
FIG. 3 is the one piece armature of the present invention.
Figure 4:
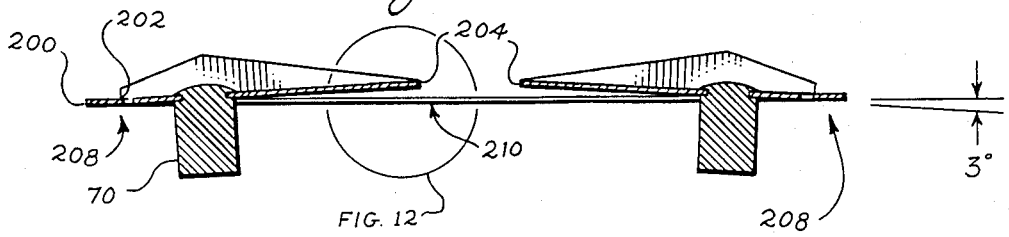
FIG. 4 is a side view of the one piece armature in FIG. 3 taken along the line A—A.
Figure 6:
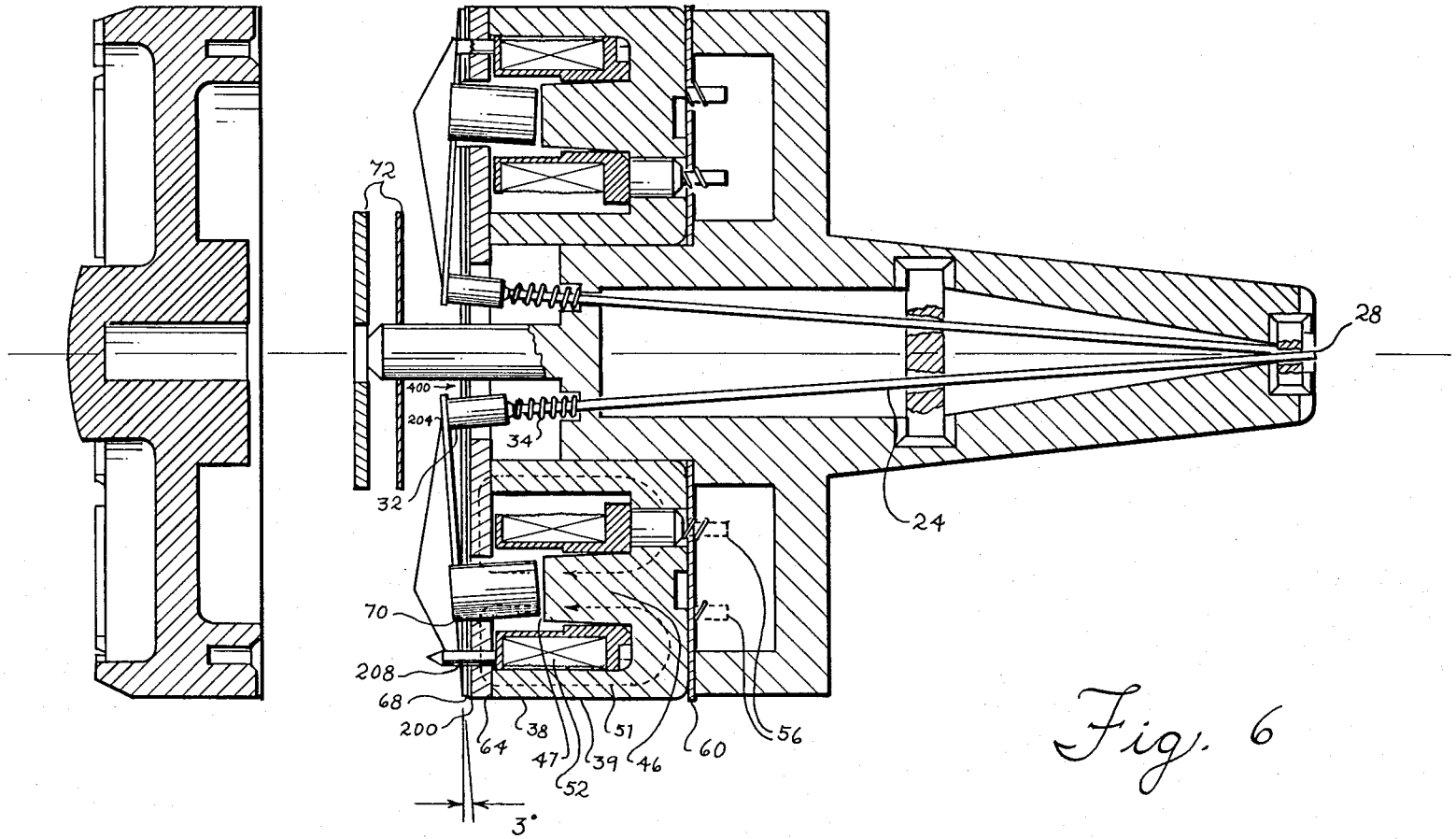
FIG. 6 is an enlarged sectional view of a partially disassembled print head of FIG. 1 (without ribbon guide).

Referring now to FIG. 3 , one piece armature 68 has periphery 200 in the shape of a polygon. Affixed to periphery 200, at arm base 202, is rigid radial arm 204. Each of rigid radial arms 204 has a pair of folded flanges 206 for rigidity. Each rigid radial arm 204 also has a moving core 70 affixed by either riveting (FIGS. 4 & 10) or welding (FIGS. 6 and 13). In FIG. 11, cut out 218 is provided to relieve stresses that would build in the corner of rigid radial arm 204 on arm base line 208. The provision of cut out 218 causes such torsional stresses to be distributed over torsional region 216 and, as a result, the clamping reaction supplied by cap 78 to clamped pad 212 does not cause stresses above the endurance limit, resulting in premature failure. A slight bend 208, of about 3 degrees in the preferred embodiment, is made along the arm base line 208 to bias the radial arms 204 in a rearward direction opposite to that traveled by wire assembly 24 when it is activated. The biasing action is produced from the combination of the bend on base line 208 near periphery 200 and the clamping action produced by the clamping pads 304 of the cap 78 (FIG. 8) acting on clamped area 212, FIGS. 11 and 4. This is shown clearly in FIGS. 4 and 12, where under normal conditions rigid radial arms 204 are out of alignment with plane 210 which is formed by the sides of periphery 200. In FIG. 12, loaded position 222 shows the position of armature 204 when it is in a ready to fire mode. Free position 220 shows the displacement of armature 204 as a result of the slight bend 208. Fire position 224 shows the armature 204 in its most forward position from firing wire rod 26. In FIGS. 3 and 11, holes 214 are provided in one piece armature 68 for receiving locating pins 62 of coil assembly 48 (FIG. 2).

In FIG. 11, the individual armatures of one piece armature 68 have a unique geometrical attachment to periphery 200. It has been discovered that by providing cut out portion 218, stresses do not build in the area of arm base 202. If cut out portions 218 were not provided, armature 204 would fracture near bend line 208 after a very small number of oscillations. As shown in FIG. 14, cut out portion 218 is constructed in a curve using two radii, R1 and R2, that are centered on a point that is a specified distance from the center of hole 214. In the preferred embodiment D is 1.35 mm, R1 is 0.25 mm, R2 is 0.1 mm and R3 is 0.35 mm.

Now referring to FIG. 2, cap 78 clamps, at 18 to 27 pounds, periphery 200 of one piece armature 68, residual 66 and focus plate 64 to metallic cup 38 by the reaction of spring 80 against clamping ring 82. The individual fingers 84 of spring 80 fit in the ledges 86 of cap 78. The end positions 88 of clamping ring 82 press against up-fingers 90 of spring 80 and when said clamping ring 82 is positioned in groove 17 of heat sink 16, the entire print head assembly is held in place.

FIG. 8 shows the underside of cap 78, which abuts one piece armature 68. Cap 78 has holes 300 for receiving locating pins 62 of coil assembly 48 and platform 302 for positioning backstop 72. Clamping arms 304 of cap 78 contacts and loads clamping pad 212 of one piece armature 68 against the stator assembly comprised of cup 38, coils 48, flux plate 64 and residual 66. Cap 78 can be constructed of any long wearing non-conductive material. In the preferred embodiment, cap 78 is constructed out of nylon.

Now referring to FIG. 6, which shows the partially assembled print head, and FIG. 13, which shows a fully assembled print head, the operation of the print head will be explained. A voltage is placed across pins 56 by signal means 60 causing current to flow in coil 52. The current in coil 52 produces a magnetic field having field lines 51 that are concentrated in metallic cup 38. The magnetic field follows lines 51 along outer edge 39 of metallic cup 38, up through post 46, crossing gap 47, through moving core 70 to focus plate 64 and back to metallic cup 38. The magnetic field produced by the current flowing in coil 52 causes moving core 70 to be attracted to post 46. The action of moving core 70 drives radial arm 204 of one piece armature 68 in a forward direction 400. The movement of radial arm 204 imparts a driving force to head 32 that compresses biasing spring 34 and drives end 28 against an ink ribbon and the ribbon against a record medium, such as paper, leaving a dot on the paper.

When the voltage is removed from pins 56, current stops flowing in coil 52 eliminating the magnetic field and ending the attraction between moving core 70 and fixed post 46. Without a force applied in direction 400, radial arm 204 returns to its normal rest position under the action of both compressed biasing spring 34 and torsion in the periphery 200, through the bend 208 in one piece armature 68. Backstop 72 absorbs any excess recoil energy in rigid arm 204 and print wire assembly 24. By selectively energizing the individual coils, the individual print wires are selected and dots are placed on the record medium in such a way that characters are formed.

Figure 10:
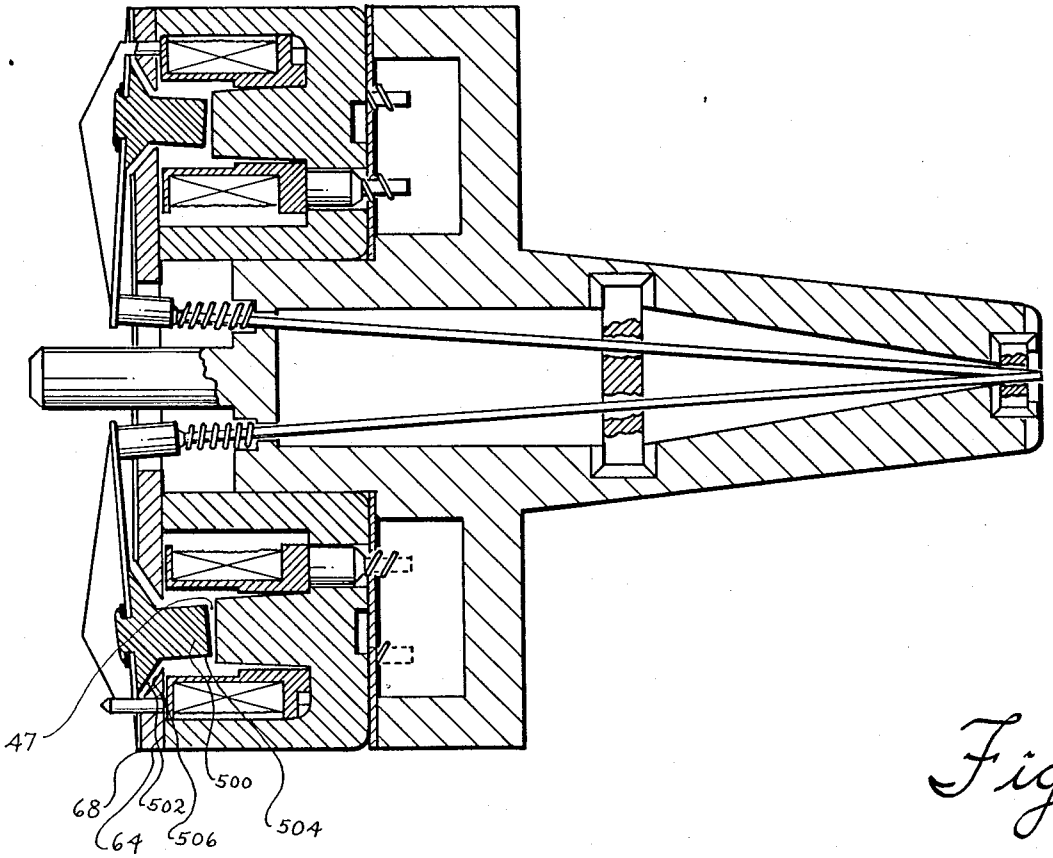
FIG. 10 is an alternative embodiment of the print head made according to this invention where the magnetic gap between the moving core and focus plate is the shape of the lateral surface of a frustum of a cone.

FIG. 10 illustrates an alternative embodiment of one piece armature 68 and focus plate 64. In this alternative embodiment, moving core 500 is comprised of head 502 and base 504. Head 502 is formed in the shape of a frustum of a cone while base 504 is formed in the shape of a cylinder. Modified hole 506 in focus plate 64 is configured in a complementary shape to that of head 502. The configuration of head 502 and modified hole 506 provides a synergistic magnetic attraction acting on moving core 500 complementing the attraction acting in gap 47 and thereby increasing the efficiency and improving the performance of the print head.

It is intended that all matter contained in the forgoing description or shown in the accompanying drawings shall be interpreted as illustrative and not in a limiting sense. While the invention has been particularly shown and described with reference to the preferred embodiment, it will be understood by those skilled in the art that changes in form and detail may be made without departing from the spirit and scope of the invention.

I claim:

1. A print head for a dot matrix printer comprising:

a frame assembly;

a print wire assembly including a print wire (rod) having one end for driving a ribbon against a record medium and a second end including a print wire head and a (sprint) spring where said spring is compressed between said head and a spring-seat in said frame assembly:

a stator assembly including a cup having a plurality of posts, a plurality of coil assemblies, each of said posts surrounded by one of said coil assemblies, a flux plate mounted on said cup and coil assemblies, and a residual mounted on said flux plate (and a signal means connected to said coil assemblies for selectively activating each of said coil assemblies);

a one piece armature constructed of thin sheet metal having a flexible periphery with a plurality of rigid radial arms connected at said periphery by a bent arm base having a cutout section for relieving bending stresses and radiating inwardly therefrom for driving said wire against said ribbon in opposition to the bias of said spring, each of said rigid radial arms having folded flanges to provide rigidity, said flexible periphery further having clamping pads only between said rigid radial arms for clamping said one piece armature into fixed contact with said cup of said stator assembly through said residual and said flux plate, said rigid radial arms biased away from said head end of said print wire by the torsional action of the bent arm base due to the clamped pads only between the radial arms of said of said flexible periphery; (and radiating inwardly therefrom for driving said print wire assembly in a forward direction, each of said rigid radial arms having a pair of flanges folded to provide rigidity, each of said rigid radial arms associated with said arm base, each of said arm bases having a pair of cut out portions for relieving stress and a slight bend between said cut out portions for biasing said associated rigid radial arm in a rearward direction against a backstop, the rearward biasing of said rigid radial arm being supplied by a combination of torsional action in said flexible periphery, a fixed clamping action of a cap and a rearward bend at said arm base);

a plurality of posts affixed to said one piece armature, one of said posts affixed to each of said rigid radial arms and extending opposite said flanges into a cavity of said coil assemblies, said post being constructed of a high permeability, high saturation level, low coercive force magnetic material; and electronic means for selectively activating and deactivating each of said coil assemblies, each of said coil assemblies, when activated, driving said associated rigid arm against one of said print wire heads and returning said rigid arm to a rest position when said coil assembly is deactivated.

2. The print head according to claim 1 wherein the top of each of said posts is shaped as a lateral surface of a frustum of a cone and said flux plate opening has a shape complementary to that of said post top.

3. The print head of claim 1 wherein said print wire has a crooked head encapsulated within a visco elastic material for mounting said print wire on said spring-seat and providing a bearing surface for said spring to bias said print wire against said one piece armature.

4. A print head for a dot matrix printer comprising:

a plurality of print wires;

a frame;

a stator assembly including a plurality of fixed posts constructed of magnetically permeable material and a plurality of coils, each of said fixed posts and coil pairs defining a cavity, said stator assembly seated against said frame;

a one piece armature for driving said print wires against a record medium, said one piece armature having a flexible periphery with a plurality of radial arms with pads clamped only between the radial arms, each of said radial arms connected at said periphery by an associated arm base and radiating inwardly therefrom, each of said associated arm bases having a pair of cutout portions for biasing said radial arm in a direction opposite to that traveled by said driven print wire when said armature is in an energized position;

a plurality of moving cores constructed of a magnetically permeable material, each of said moving cores affixed to an associated radial arm and extending into said cavity to define a gap between said core and said fixed posts when said armature is in a rest position;

a flux plate and a residual for separating said one piece armature from said stator assembly and for receiving said moving cores; and electronic means for selectively energizing each of said coils, which when activated cause said moving core to be attracted to said fixed post driving said radial arm against said print wire.

5. The print head according to claim 4 wherein each of said radial arms has a pair of folded flanges for providing rigidity.

6. The print head according to claim 4 wherein each of said moving cores is shaped as a lateral surface of a frustum of a cone and said flux plate opening has a shape complementary to that of said moving core.

7. The print head according to claim 4 wherein each of said moving cores is constructed of high permeability, high saturation level, low coercive force magnetic material.

8. In a print head for a dot matrix printer having print actuating means for driving a print wire against a ribbon and a plurality of electromagnetic actuators for imparting a driving force to said print actuating means, each of said electromagnetic actuators having a stator post surrounded by a coil, said post and coil defining a cavity, the improvement in said print actuating means comprising:

a one piece armature, constructed of thin sheet metal, having a plurality of rigid radial arms radiating inwardly from a flexible periphery and having clamp pads only between said radial arms on said flexible periphery; (and)

means for clamping said clamp pads of said flexible periphery to said print head to impart torsional force to said flexible periphery;

each of said radial arms having a moving core affixed thereto and an arm base, slightly bent, having a pair of cut out portions for relieving stress, said moving core extending into said cavity to define a gap between said core and said stator post when said radial arm is in a rest position, said arm base attached to said flexible periphery.

9. The print head according to claim 8 wherein each of said moving cores has a head shaped as a lateral surface of a frustum of a cone.

10. The print head according to claim 8 wherein each of said radial arms has a pair of folded flanges for providing rigidity.

11. The print head according to claim 8 wherein each of said moving cores is constructed of high permeability, high saturation level, low coercive force magnetic material.

12. A print head in a dot matrix printer comprising:

print actuating means for driving a print wire against a ribbon;

a plurality of electromagnetic actuators for imparting a driving force to said print actuating means, each of said electromagnetic actuators having a stator post surrounded by a coil, said post and coil defining a cavity;

a one piece armature, constructed of thin sheet metal, having a plurality of radial arms a radiating inwardly from a flexible periphery and having clamps pads only between said radiating arms on said flexible periphery; (and)

means for clamping said clamping pads firmly to said print head for imparting torsional force to said radiating arms of said one piece armature;

each of said radial arms having a moving core affixed thereto and attached to said flexible periphery an associated arm base having a plurality of cut out portions for relieving stress, said moving core extending into said cavity to define a gap between said core and said stator post when said radial arm is in a rest position

13. The print head of claim 1 wherein each of said cut out portions separates said flange and said periphery.

14. The print head of claim 1 wherein at least one of said cut out portions is a curve.

15. The print head of claim 4 wherein at least one of said cut out portions is a curve.

16. The print head of claim 8 wherein at least one of said cut out portions is a curve.

17. The dot matrix printer of claim 12 wherein at least one of said cut out portions is a curve.

* * * * *